US005189768A

United States Patent [19]

Riceman et al.

[11] Patent Number: 5,189,768

[45] Date of Patent: Mar. 2, 1993

[54] SNAP FASTENER WITH SEPARATOR SPRING

[75] Inventors: Robert G. Riceman, West Caldwell; Mitchell A. Medina, Essex Fells, both of N.J.

[73] Assignee: Randolph-Rand Corporation, New York, N.Y.

[21] Appl. No.: 783,873

[22] Filed: Oct. 29, 1991

[51] Int. Cl.[5] ..... A44B 17/00

[52] U.S. Cl. ..... 24/634; 24/632; 24/662

[58] Field of Search ..... 24/634, 632, 631, 645, 24/662, 679, 696, 602, 603, 499, 500, 501, 511, 673, 679

[56] References Cited

U.S. PATENT DOCUMENTS

| | | | |
|---|---|---|---|
| 1,103,455 | 7/1914 | Tufts | 24/511 |
| 1,320,832 | 11/1919 | Bourque . | |
| 1,425,618 | 8/1922 | Vodicka . | |
| 1,647,781 | 6/1924 | Carr . | |
| 2,455,258 | 11/1948 | Levitin | 24/501 |
| 2,816,340 | 12/1957 | Domenech et al. | 24/634 |
| 3,308,516 | 3/1967 | Mullan | 24/678 |
| 3,538,557 | 11/1970 | Hirose . | |
| 3,769,664 | 11/1973 | Parera | 24/662 |
| 4,077,092 | 3/1978 | Basevi | 24/500 |
| 4,099,303 | 7/1978 | Parera | 24/662 |
| 4,813,111 | 3/1989 | Nohren | 24/632 |

*Primary Examiner*—Victor N. Sakran

*Attorney, Agent, or Firm*—Wenderoth, Lind & Ponack

[57] ABSTRACT

A snap fastener has a female member including a snap type resilient clamp having a dished resilient actuator plate and a plurality of legs depending from the periphery thereof having inwardly extending hooks on the free ends and a casing in which the clamp is positioned, and a male member having a hook receiving recess therearound and insertable into the space within the legs with the hook receiving recess in opposed relation to the hooks for causing the male member to be gripped by the hooks when the clamp is in a closed position and for freeing the male member for movement into and out of the space when the snap type resilient clamp is in an open position. A spring or the like is provided between the female snap member and the male member and compressed when the female snap member and the male member are brought together and the hooks grip the male member engaging position and urging the female snap member and the male member apart when the dished resilient actuator plate is moved to a concave position for releasing the hooks. Various types of actuating members can be provided to move the dished resilient actuator plates.

35 Claims, 8 Drawing Sheets

SNAP FASTENER WITH SEPARATOR SPRING

The present invention relates to a snap fastener, and more particularly to a snap fastener with a snap-type resilient clamp having a dished resilient actuator plate which can be resiliently snapped between a position in which the actuator plate is convexly dished to a position in which the plate is concavely dished for moving hooks on depending legs out of a recess in a male member so as to free the male member, to permit separation of the male and female member, and which includes means for enabling a more positive separation of the male and female members. This means can be an actuator which moves transversely or opposite to the direction of movement of the dished resilient actuator plate, or a spring which is compressed between the male and female members for separating the male and female members when the snapping of the dished resilient actuator plate moves the hooks to free the male member, or a combination of both.

BACKGROUND OF THE INVENTION

Snap fasteners with dished resilient actuators of the above-described type are known. In such snap fasteners, there is provided a female member having a casing having an inwardly turned flange on the lower edge thereof defining a bottom opening, and which holds therein a resilient clamp, which has a dished resilient actuator plate which can be moved with a snap action from a convex position, to a concave position, by which action, hooks on the lower ends of legs depending from the peripheral edge of the actuator disk are moved out of an annular recess in a male fastener member to free the male member for movement out through the bottom opening of the casing. The casing may be provided with fixing pieces against the outer periphery thereof for fixing it to a layer of material which is to be held against a layer of material to which the male member may be held by a flange on the outer end of a tubular piece which is connected to the portion of the male member which engages the dished resilient actuator plate. Positioned over the top of the casing is a baffle, and the casing, the fixing piece and the baffle are clamped together by a cover which has an access opening through the center thereof through which manual pressure, such as from a finger of a user, can be exerted for moving the dished resilient actuator plate from a convex postion to a concave position.

Snap fasteners of this type have been alleged to be useful for such items as pocketbooks in which a flap overlies the main part of the pocketbook and must be secured thereto by some sort of a releasable fastening means, or such other containers as briefcases, soft luggage and the like, which require basically the same attachment of a flap to the main body of the piece of luggage. Such snap fasteners have also been alleged to be useful in clothing items, such as coats and the like, where it is desired to secure an overlying layer to an underlaying layer by a releasable fastener.

These fasteners have a simple structure and are quite reliable in operation, and they are easily brought together and secured simply by inserting the male member into the opening in the bottom of the casing, and bringing the annular edge of the male member against the dished resilient actuator plate to move it from a concave condition to a convex condition, at which point the legs are swung inwardly to move the hooks into the recess for securing the parts of the fastener together.

However, the fastener has not found acceptance in the marketplace. This is because when the dished resilient actuator plate is moved to a concave position for swinging the legs outwardly to move the hooks out of the recess, there is nothing which will cause the parts of the fastener to separate from each other. Some additional force is needed on one or the other, or both, of the parts to cause them to move apart, i.e. to move the male member relatively to the female member so that it moves out of the female member. Further, since the force which must be exerted on the dished resilient actuator plate for moving the hooks out of the recess to free the male member from the female member is in the direction toward the male member, the natural tendency is for the parts to be urged together rather than apart. Accordingly, the user is often uncertain whether the dished resilient actuator plate has actually snapped from the convex condition to the concave condition and whether the parts of the snap fastener are actually free to be separated by exerting a force on one or the other of the members to move the members away from each other.

A fastener of this type would be very acceptable if it could be actuated by a force in a direction other than in a direction for moving the parts toward each other, i.e. transversely or opposite to such direction so as enable the user to readily separate the parts after the hooks on the female member have moved out of the recess on the male member.

A fastener of this type would also be very acceptable if it had some way of immediately causing the male and female parts to separate from each other upon the actuation of the dished resilient actuator plate so that the user would know that the dished resilient actuator plate had been moved from the convex to the concave condition and that the parts were free to separate, and also to avoid the necessity for exerting an initial force on one or the other of the parts to move the parts away from each other.

OBJECTS AND BRIEF SUMMARY OF THE INVENTION

It is a first object of the present invention to provide a means in a snap fastener of the type described hereinbefore for causing the parts of the snap fastener to be moved away from each other upon the changing of the condition of the dished resilient actuator plate from the convex condition to the concave condition.

It is a further object of the present invention to provide means for moving the dished resilient actuator plate from the convex condition to the concave condition which do not require exertion of a force on the female member of the snap fastener in a direction for urging the female member of the snap fastener toward the male member.

To this end, the present invention provides a snap fastener comprising a snap type resilient clamp having a dished resilient actuator plate and a plurality of legs depending from the periphery thereof having inwardly extending hooks on the free ends thereof and defining a male member receiving recess therewithin, said dished resilient actuator plate being able to be resiliently snapped between a closed position in which said dished resilient actuator plate is convexly dished, and said legs are in an inward position with said hooks in a radially inward engaging position, and an open position in which said dished resilient actuator plate is concavely dished and said legs are in an outwardly inclined position with said hooks in a radially outward disengaging position; casing means in which said snap type resilient clamp is positioned for movement between said closed position and said open position, said casing means optionally including means for attaching said casing means to a sheet of material as a female snap member; a male member having a hook receiving recess therearound and insertable into said male member receiving recess to position said hook receiving recess in opposed relation to said hooks for causing said male member to be gripped by said hooks when said snap type resilient clamp is in the closed position and for freeing said male member for movement into and out of said male member receiving recess when said snap type resilient clamp is in the open position, and optionally means for attaching said male member to a further sheet of material; actuating means engagable with said dished resilient actuator plate and movable in a direction other than direction of movement of said dished resilient actuator plate from the convex to the concave condition for moving said dished resilient actuator plate from the convex to the concave condition; and resilient means between said female member and said male member for being compressed when said members are moved together for exerting a force on said members for moving said members away from each other; whereby when said hooks are moved out of said recess in said male member to free said female snap member from said male member and to cause said compressed resilient means to urge said female snap member away from said male member.

The actuating means can be a lever or levers mounted on the casing means which has an outer end or ends movable away from the casing means and which has an inner end or ends for moving the resilient actuator plate from the convex to the concave condition.

The actuating means can alternatively be an actuator slide mounted on said casing means for movement laterally across said dished resilient actuator plate for changing said plate from the convex shape to the concave shape, such as an actuator slide pivotally mounted on said casing means, or an acuator slide slidably mounted on said casing means.

The snap fastener can further comprise lock means on said casing means for, in a locked condition, blocking movement of said slide means, and in an unlocked condition, freeing said slide means for lateral movement.

The casing means can have a cover portion extending over and covering said dished resilient actuator plate for blocking access to said dished resilient actuator plate other than by means of said lever or said slide means.

The fastener can omit the actuating means, and simply have an opening in the top of the casing through which manual force can be exerted either directly or through a baffle onto the dished resilient actuator plate.

The fastener can have the lever or actuator slide type actuating means and a resilient means adapted to be protected from accidental snagging between the male and female members at various positions.

BRIEF DESCRIPTION OF THE DRAWINGS

Other and further objects of the invention will become apparent from the following description, taken in conjunction with the accompanying drawings, in which.

DETAILED DESCRIPTION OF THE INVENTION

Figure 1:
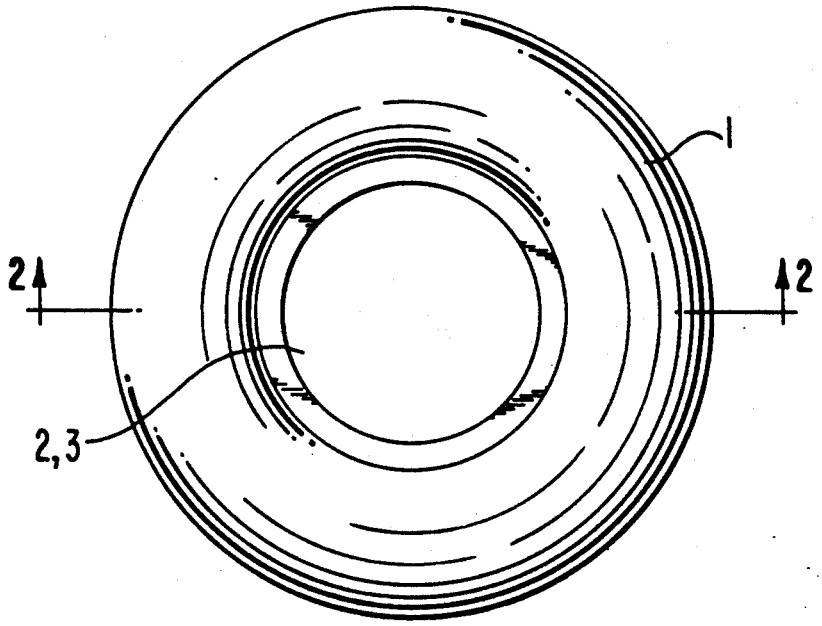
FIG. 1 is a top plan view of the snap fastener according to present invention.
Figure 2:
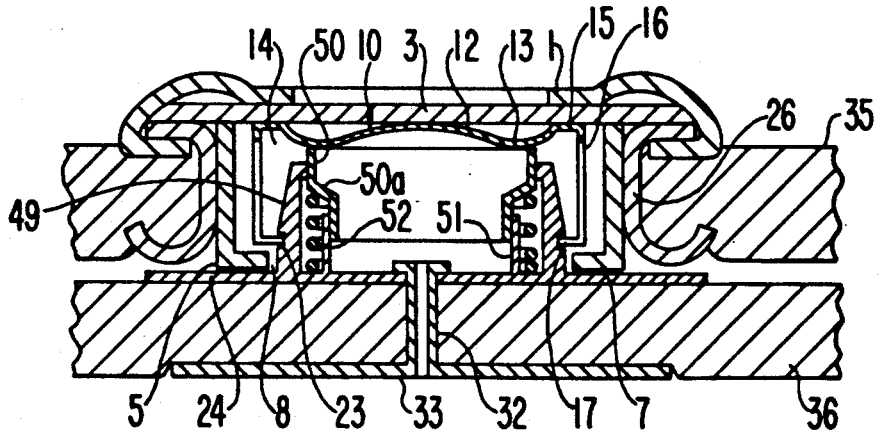
FIG. 2 is a sectional elevation view of the snap fastener taken along line 2—2 of FIG. 1, showing the resilient clamp in the closed position holding the male member in the closed position of the snap fastener.
Figure 3:
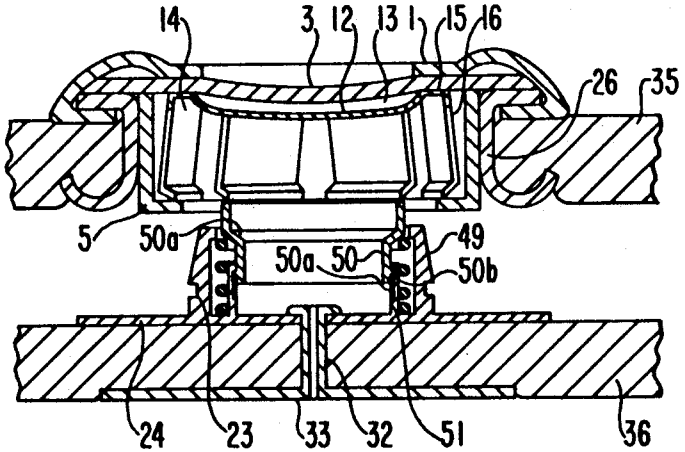
FIG. 3 is a section of the female portion of the snap fastener as shown in FIG. 2 with the resilient clamp in the open position and the male member removed from the female member.

As shown in FIGS. 1–3, the snap fastener according to the first embodiment of the invention has a basic structure having a female snap member with a snap-type resilient clamp 10 having a dished resilient actuator plate 12 with a plurality of legs 16 depending from the periphery thereof, and which have inwardly extending hooks 17 on the free ends thereof. The resilient clamp 10 thus defines a male member receiving recess 14 therewithin. The dished resilient actuator plate is one which is able to be resiliently snapped between a closed position as shown in FIG. 2, in which the dished resilient actuator plate 12 is convexly dished, and the legs 16 are in a radially inward position with the hooks 17 in a radially inward engaging position, and an open position, as shown in FIG. 3, in which the dished resilient actuator plate 12 is concavely dished, and the legs are in an outwardly inclined position with the hooks 17 in a radially outward disengaging position.

The resilient clamp 10 is housed within a casing means 5, for movement between the closed position and the open position, the casing means 5 having an inwardly extending flange 7 defining an opening 8 through which the male member, described hereinafter, is inserted. The casing means 5 may be provided with a fixing piece 26 against the outer periphery thereof and may be engaged under an outturned flange 6 on the top of the casing means 5, and may optionally be provided with a baffle 3 extending across the top of the upwardly open casing means 5 covering the dished resilient actuator plate 12. The baffle 3 can be omitted if desired. In the embodiment shown, a cover 1 is clamped around the edges of the baffle 3, the casing 5 and the outturned edge of the fixing piece 26 to clamp these pieces together into a female snap member. However, the baffle 3, casing means 5 and fixing piece 26 can be attached in any other conventional way, such as by spot welding or an adhesive, such as epoxy. The female snap member may be held on or otherwise attached to a layer 35 of one piece of material which is to be attached to a second piece of material 36 by the snap fastener.

A male member is provided which in this embodiment has a hook engaging member 49 having around the base thereof a hook receiving recess 23 into which the hooks 17 engage when the resilient clamp is in the closed position. Extending outwardly from the hook engaging member 49 is an external flange 24 adapted to lie against one surface of the second sheet of material 36, which may optionally extend radially outwardly of the hook engaging member 49. The center of the flange 24 has an aperture therein into which a tubular member 32 is attached, the member 32 having a second flange 33 on the bottom end thereof for bearing against the outer surface of the second sheet of material 36, to thereby clamp the male member to the second sheet of material 36. Alternatively, the hook engaging member 49 can be a separate member attached to flange 24 by welding or glue or the like. Means other than tubular member 32 and flange 33 can be used to attach the male member to the material 36, such as prongs, buttonholes, glue or the like. Within the hook engaging member 49 is a first spring sleeve 50 which is slidable in the vertical direction in the figure within the upper end of the hook engaging member 49, and which has a shoulder **50*a* against which the upper end of a resilient means in the form of a spring 52 is engaged, the lower end of the spring being engaged with the outer surface of the flange 24. The lower end of the first spring sleeve 50 is slidably engaged in a second spring sleeve 51 on the outer surface of the flange 24 and has one or more pins 50*b* slidable in a slot or slots 51*a* in spring sleeve 51. It will thus be seen that the first spring sleeve 50 is slidable relative to the hook engaging member 49, being guided in the second spring sleeve 51, and being urged upwardly in the figure by the spring 52 against the under surface of the dished resilient actuator plate 12 at the peripheral portion 13** of the upwardly convex shape of the plate.

The spring 52 and the spring sleeves 50 and 51, together constitute spring means between the dished resilient actuator plate 12 and the remainder of the male member.

In the closed position of the snap, as shown in FIG. 2, the spring means constituting part of the male member is positioned within the recess 14 with the hooks 17 engaged in the recess 23, and the legs 16 in the radially inward closed position with the dished resilient actuator plate 12 in the convex condition. The spring 52 is somewhat compressed, and resiliently holds the upper end of the first spring sleeve 50 against the under side of the actuator plate 12. The snap fastener is thus locked, since the locking hooks 17 are engaged in the recess 23, preventing the male and female parts from being separated.

Upon the exertion of a pressure in the downward direction against the dished resilient actuator plate 12 through the baffle plate, the actuator plate is moved with a snap action from the convex condition as shown in FIG. 2 to the concave position as shown in FIG. 3, whereupon the legs 16 are swung outwardly and the hooks 17 are withdrawn from the recess 23. As a result of the freeing of the hook engaging member 49 by the outward movement of the hooks 17, the thus compressed spring is free to expand and urge the first spring sleeve and the bottom of the hook engaging member 49 away from each other, thus exerting a force to move the female snap member and the male member away from each other, thus slightly separating the sheets of material 35 and 36, as shown in FIG. 3.

The user of the snap will, by this action of the spring means, be made aware of the fact that the dished resilient actuator plate 12 has in fact been properly moved with snap action from the closed to the open position, and that the parts of the snap fastener are separated.

Upon the insertion of the male member into the female member in the reverse direction, the first spring sleeve 50 engages the dished resilient actuator plate 12, whereupon further insertion compresses spring 52, and the actuator plate 12 will be moved with a snap action from the concave position to the convex position, at which point the legs 16 are swung inwardly into engagement with the recess 23 in the hook engaging member 49, thereby locking the male member of the snap fastener into the female member with the sheets of material 35 and 36 thereby secured against each other.

Figure 4:
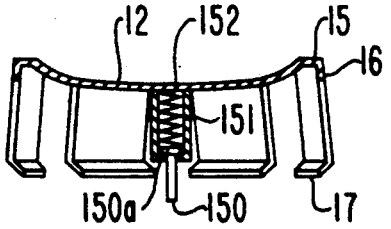
FIG. 4 is a partial sectional view similar to FIG. 3, showing a second embodiment of the snap fastener according to the present invention.

Alternatively, the spring means between the dished resilient actuator plate 12 and the remainder of the male member can be constituted by a compression force-transmitting member, here shown as a pin member and a spring compressible by the pin member when the dished resilient actuator plate is moved to the concave position of FIG. 3. One embodiment is shown in FIG. 4 in which the spring means is on the dished resilient actuator plate. A spring sleeve 151 is attached to the center of the resilient actuator plate and has an inwardly turned lower end and a coil spring 152 therein with the lower end engaged with a flange **150*a* on the inner end of a pin 150 which is urged downwardly out of the sleeve 151 by the spring 152. When the parts of the fastener are separated as shown in FIG. 4, the pin is urged to the outermost position as shown in the Figure. When the parts are moved together to the position like that shown in FIG. 2, and the resilient actuator plate is moved to the convex condition, the pin 150 is urged into the sleeve 151 by engagement with the flange 24 on the male member. When the dished resilient actuator plate is depressed to the concave position, the hooks 17 release from the hook engagement member 49**, and the energy stored in the spring urges the female snap member and male member apart from each other.

Figure 5:
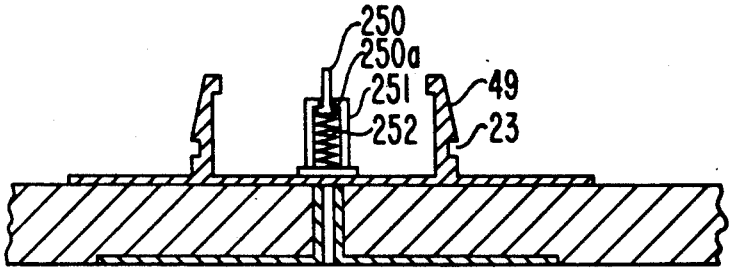
FIG. 5 is a partial sectional view similar to FIG. 3 showing a third embodiment of the snap fastener.

An alternative embodiment is shown in FIG. 5, in which the spring means is mounted on the male member. The embodiment has the sleeve 151 containing the spring 152 urging the pin 250 with the flange 250*a* on the inner end in an upward direction. As with the arrangement of FIG. 4, when the parts of the fastener are together with the dished resilient plate 12 in the convex condition as in FIG. 2, the pin 250 engages the dished resilient plate 12 so as to be urged into the sleeve 251. When the dished resilient plate is depressed to the concave position, the hooks 17 are released, the energy stored in the compressed spring 252 urges the female snap member and the male member apart from each other.

Figure 6:
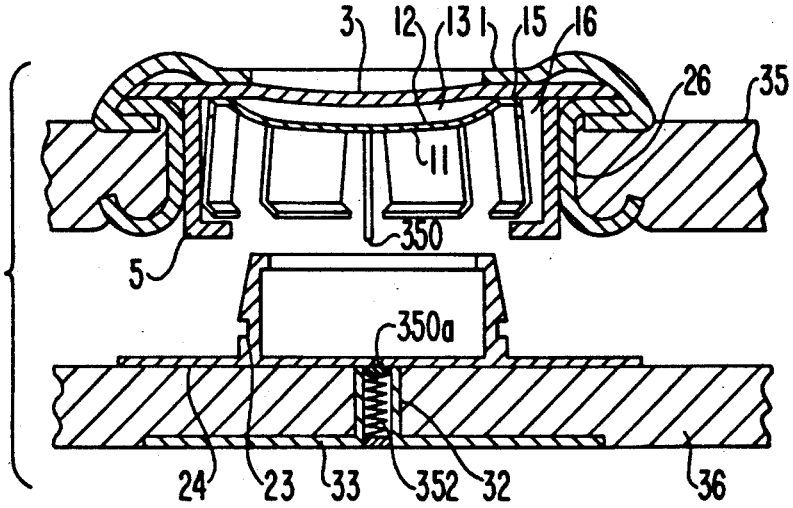
FIG. 6 is a view similar to FIG. 3 showing a fourth embodiment of the fastener.

A further alternative embodiment is shown in FIG. 6, in which the spring is on one of the members of the fastener, in the disclosed embodiment on the male member, and the pin is on the other member, in the disclosed embodiment the female snap member. The spring 352 is contained in a sleeve formed by the tubular member 32 for fastening the male member to the material 36, and has a flange member 350*a* which receives the force of the spring, and which abuts an overhanging edge (unnumbered) of flange 24. The pin 350 is mounted on the dished resilient member 12 and extends into the sleeve when the parts are together, and the members are urged apart by the compressed spring 352 when the hooks are released. An obvious alternative to this arrangement is to have the pin on the flange 24 and the sleeve with the spring therein on the dished resislient member.

It will be seen that all of the spring means are shaped and positioned in the structure so as, when the male and female members are apart, the spring means are protected against accidental snagging or deformation by outside objects.

In the foregoing embodiments, the force for actuating the dished resilient actuator plate must still be exerted in a direction tending to move the female member onto the male member, and it would be a further advantage to the snap fastener of the present invention if the force were exerted in the opposite direction.

Figure 8:
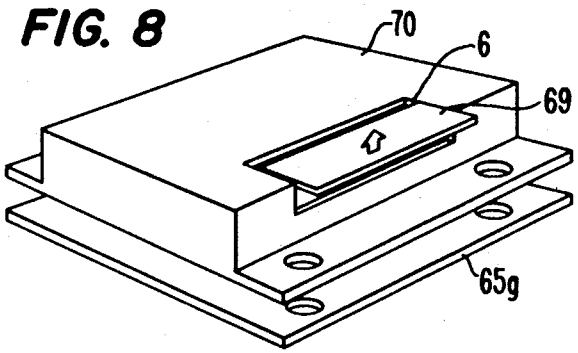
FIG. 8 is a perspective view of a snap fastener incorporating the female part and actuator of FIG. 7 and showing the movement of the actuator member for moving the resilient clamp to the open position.
Figure 7:
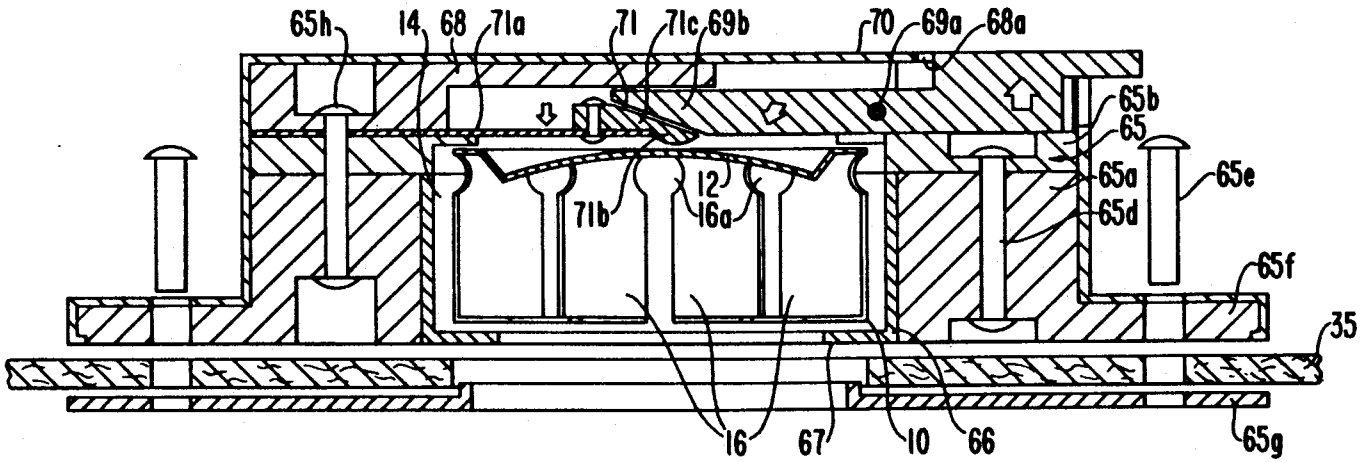
FIG. 7 is a sectional view of a second embodiment of the female part and actuator means of the snap fastener according to the present invention showing one form of actuator means for the resilient clamp, and showing the resilient clamp in the closed postion.

The present invention contemplates providing special actuating members for applying the actuating force in such a direction, which is shown in FIGS. 7 and 8. As can be seen from these figures, the female member of the snap fastener has casing means 65 which houses the resilient clamp 10 in substantially the same manner as in the first embodiment, i.e. a flange ring 66 housed in recess 14 has an inwardly turned flange 67 at the lower end and receives the male member (not shown) in the same manner as shown in FIGS. 2 and 3. An upper casing part 65*b* is secured to the lower casing part 65*a* by rivets 65*d* or the like and extends over the upper part of recess 14. It is noted also that resilient clamp 10 may be provided with enlarged openings 16*a* at the roots of legs 16 to better spread the stress where legs 16 are attached to the plate 12, as shown in FIG. 7. The casing means 65 can be secured to the upper sheet 35 of the material by, for example, rivets 65*e* projecting downwardly through a mounting flange 65*f* on the casing means 65, and which are held against the under side of the upper sheet of material 35 by a washer 65*g*, which is a conventional way of fastening items to sheet material. Other fastening means, such as prongs, sewing, glueing, and the like, may be used.

The casing means 65 has a cover portion 68 attached to casing means 65 by rivets 65*h*, and cut away at 68*a* to accommodate an actuator lever 69 which is pivotally mounted on a shaft 69*a* on the cover portion 68 for pivotal movement up and down in FIGS. 7 and 8. The casing means 65 and cover portion 68 are covered by a cover 70, preferably of a decorative material such as brass, and held in place by rivets 65*e* or other fastening means. The actuator lever 69 has a tapered tip 69*b* on the inner end thereof which is above the center of dished resilient actuator plate 12 of the resilient clamp 10.

An actuator head 71 attached to a spring plate 71*a* held between the cover portion 68 and casing means 65 has a tip 71*b* over the center of plate 12 and an inclined upper face 71*c* opposed to the tapered tip 69*b* of lever 69.

The male member of the fastener is the same as for the embodiment of FIGS. 2 and 3, and is not shown.

When the lever 69 is lifted upwardly in a direction away from the casing means 65 to pivot around the shaft 69*a*, the tapered tip 69*b* engages the actuator head 71 to move it down, which drives the dished resilient actuator plate 12 from the convex position to move it with a snap action to the concave position, thereby moving the legs 16 to the open position so as to withdraw the hooks 17 from the recess 23 in the male member.

The spring plate 71 raises the actuator head 71 against the tip 69*b* to return the actuator lever 69 to the position of FIG. 7 when the actuating force thereon is released, thereby freeing the dished resilient actuator plate to enable it to return to the convex position upon reinsertion of the male member into the female member.

It will thus be seen that the force which is exerted on the female member of the snap fastener to move the actuator plate from the convex position to the concave position is exerted in the opposite direction to the direction of movement of the actuator plate, i.e. away from the direction of separation of the parts of the snap fastener. Thus, it is relatively easy to allow the parts of the snap fastener to be moved apart by the force of the spring 52 in the male member, and to lift the female part of the snap fastener away from the male part. The user does not tend to close the snap fastener further by the force necessary to actuate the dished resilient actuator plate, thus making the snap fastener more natural to actuate and to move the female member away from the male member.

Figure 9:
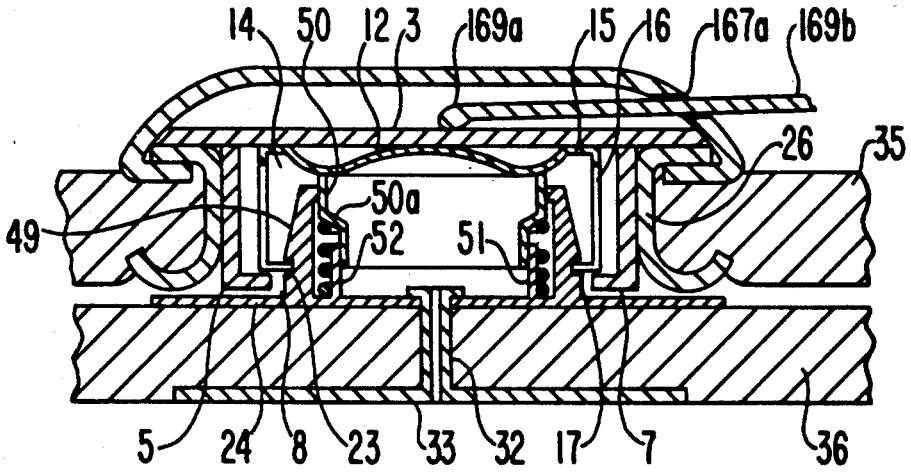
FIG. 9 is a view similar to FIG. 2 but showing an actuator of a type similar to that of FIG. 7.
Figure 10:
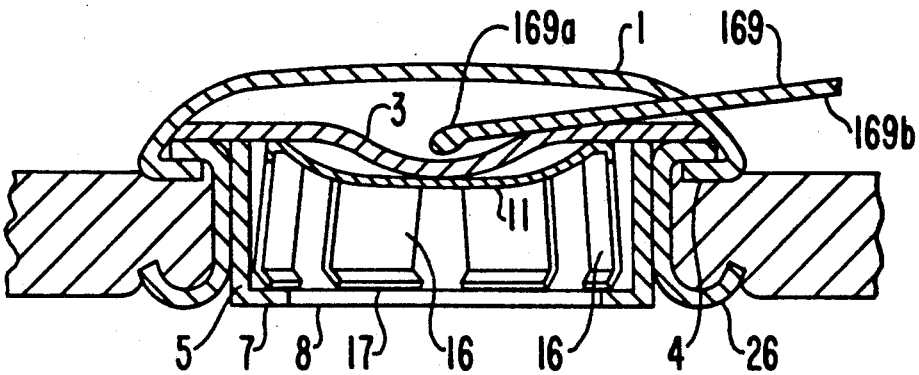
FIG. 10 is a view similar to FIG. 9 showing the actuator in the raised condition.

A somewhat simpler structure for accomplishing the same actuating movement, i.e. in a direction of separating the female snap member from the male member, is shown in FIGS. 9 and 10. In this embodiment a lever member 169 is incorporated into the structure of FIGS. 1-3. The annular cover 1 is replaced by a full cover la having a lever receiving aperture 167*a* at one position around the periphery thereof through which the lever 169 extends. At the end of the lever 169 within the cover and at about the center of the optional baffle 3 is an actuating portion 169*a*, and at the other end of the lever 169 outside the cover 1*a* is a finger engaging portion 169*b*. It will be seen that with the parts in the positions of FIG. 9, when a force away from the female snap member is exerted by the fingers of a user on the finger engaging portion 169*b*, the lever 169 will pivot on the edge of the aperture 167*a* to move the actuating portion 169*a* downwardly against the dished resilient plate 12 through the optional baffle 3 to move the plate 12 to the concave condition as shown in FIG. 10. Spring means can be provided if desired to return the lever to its initial position, or the natural resiliency of the baffle and/or dished resilient plate can be used for this purpose.

Figure 11:
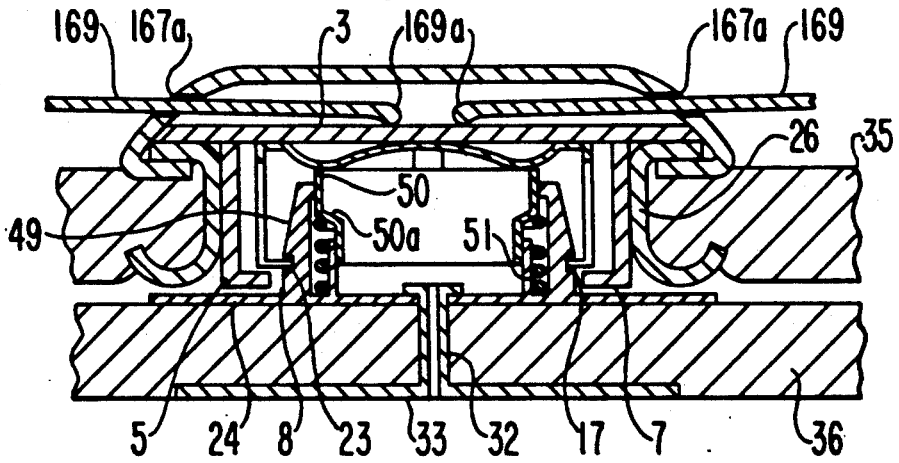
FIG. 11 is a view similar to FIG. 9 showing a similar actuator.

A modification of the embodiment of FIGS. 9 and 10 is shown in FIG. 11, in which instead of a single lever 169, a plurality of levers 169 are spaced circumferentially around the cover la, extending out through apertures 167*a*.

Figure 12:
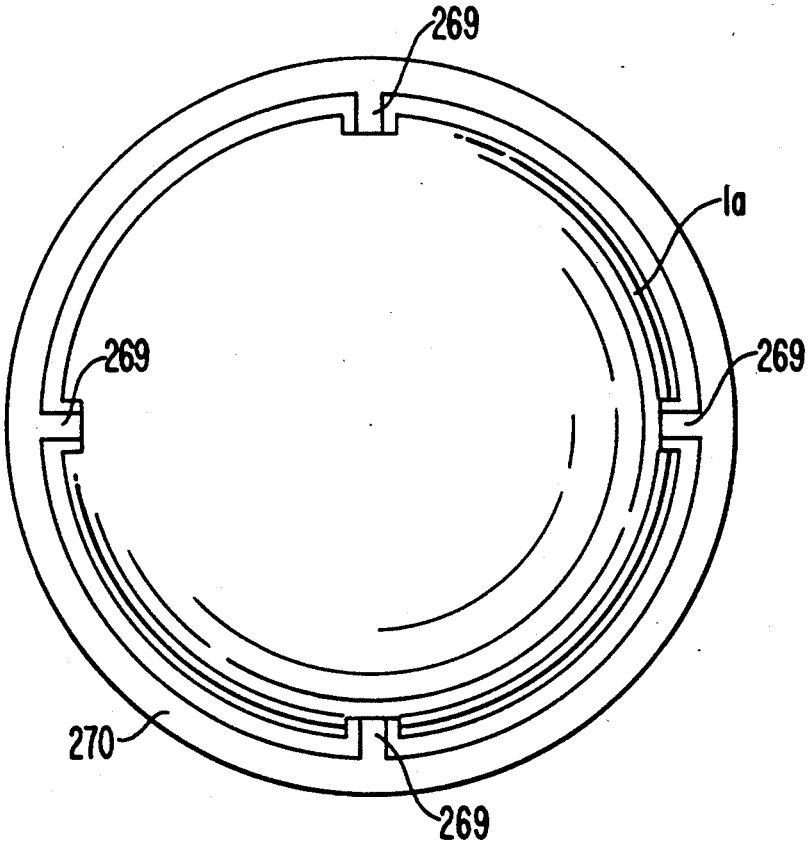
FIG. 12 is a plan view of FIG. 11.

In the modification of FIG. 12, the finger engaging portions of levers 269 are joined by a ring 270, so that the force necessary to actuate the dished resilient member 12 can be produced by a force exerted anywhere around the ring 270. Otherwise, the lever action is the same, although it is possible that two levers will be actuated by the ring at the same time.

In the foregoing embodiments, the force for actuating the dished resilient actuator plate must be exerted in a direction in line with the movement of the female member onto the male member, i.e. either in the same direction or in the opposite direction. It may be advantageous for the snap fastener of the present invention if the force were exerted laterally of the direction of movement of the female member onto and off the male member, i.e. more or less parallel to the surface of the sheet of material which overlies the second sheet to which it is to be attached.

Figure 13:
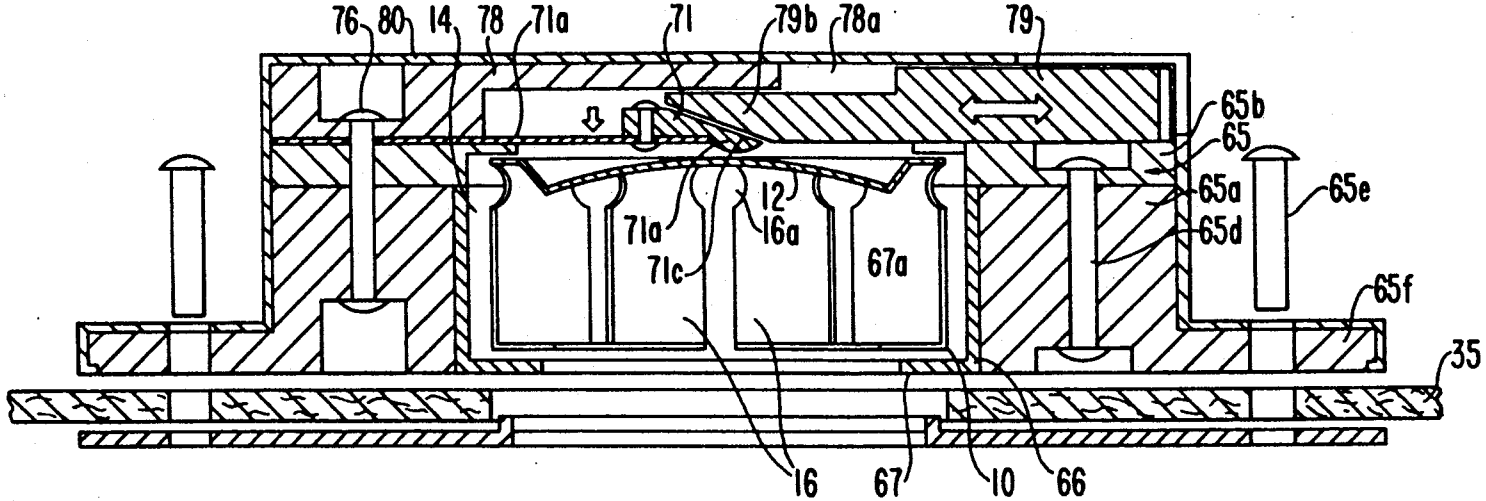
FIG. 13 is a view similar to FIG. 7 of a further embodiment of the female part and actuating means of the snap fastener of the present invention.
Figure 14:
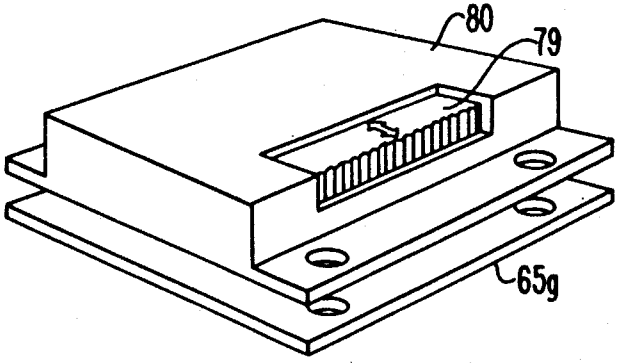
FIG. 14 is a perspective view of a snap fastener incorporating the female part and actuator of the embodiment of FIG. 13.

The present invention further contemplates providing further special actuating members for applying the actuating force in such a direction, which are shown in FIGS. 13–17. As can be seen in FIG. 13, the female member of the snap fastener is substantially the same as that of the embodiment of FIGS. 7 and 8, in that it has casing means 65 which houses the resilient clamp 10 by means of the flange ring 66 housed in recess 14, and the clamp 10 receives the male member (not shown) in the same manner as shown in FIGS. 2 and 3. An upper casing part 65*b* is secured to the lower casing part 65*a* by rivets 65*d* or the like and extends over the upper part of the recess 14. The resilient clamp 10 is shown as having the enlarged openings 16*a* as in the embodiment of FIGS. 7 and 8. The casing means may be secured to the upper sheet 35 of the material by rivets 65*e* extending through the mounting flange 65*f* on the casing means 65, and they are held against the under side of the upper sheet 35 by a washer 65*g*.

The casing means 65 of this embodiment has a cover portion 78 attached to casing means 65*a* by rivets 76, similar to cover portion 68 of the embodiment of FIGS. 6 and 7, and the cover portion 78 is also cut away at 78*a* to accommodate an actuator slide 79 which is slidably mounted on the upper surface of upper casing part 65*b* for sliding movement into and out of the cover portion 78 in the directions of the arrow. The casing means 65 and the cover portion 78 are covered by a cover 80, preferably of a decorative material such as brass, and may be held in place by rivets 65*e*. The actuator slide 79 has a tapered tip 79*b* on the inner end thereof which is above the center of the dished resilient actuator plate 12 of the resilient clamp 10.

An actuator head 71, like that in the embodiment of FIGS. 7 and 8, has a spring plate 71*a* held between the cover portion 78 and the casing means 65 and has a tip 71*b* over the center of plate 12 and inclined upper face 71*c* opposed to the tapered tip 79*b* of the lever 79.

The male member of the fastener is the same as for the embodiments of FIGS. 2 and 3 and FIGS. 7 and 8.

When the lever 79 is caused to slide inwardly of the casing means 65, the tapered tip 79*b* engages the actuator head 71 to move it down, which drives the resilient dished actuator plate 12 from the convex position to move it with a snap action to the concave position, thereby moving the legs 16 to the open position so as to withdraw the hooks 17 from the recess 23 in the male member.

The spring plate 71*a* raises the actuator head 71 against the tip 79*b* to cause the actuator slide to slide outwardly to return to the position of FIG. 13 when the actuating force thereon is released, thereby freeing the dished resilient actuator plate to enable it to return to the convex position upon reinsertion of the male member into the female member.

Figure 15:
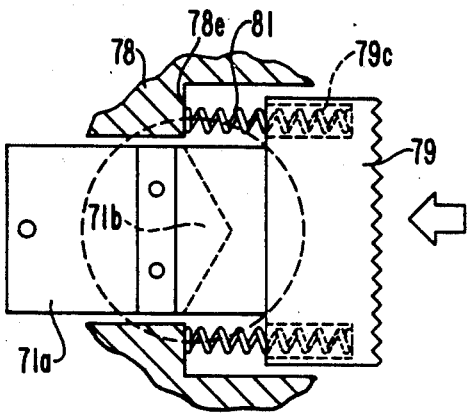
FIG. 15 is a plan view of a specific form of the actuator slide of the snap fastener of FIGS. 13 and 14.

Because of friction between the actuator head 71 and the tip 79*b*, which will lessen the return action of the spring 71*a*, it may be desirable to provide special return spring means as shown in FIG. 15. Two return springs 81 are housed in recesses 79*c* in actuator slide 79 and abut against abutting surfaces 78*c* on cover portion 78 and are in the uncompressed condition when the slide 79 is in the outer position. When the slide 79 is pushed in, springs 81 are compressed, and upon release of the force on slide 79, they act to return the slide 79 to the initial position.

Figure 17:
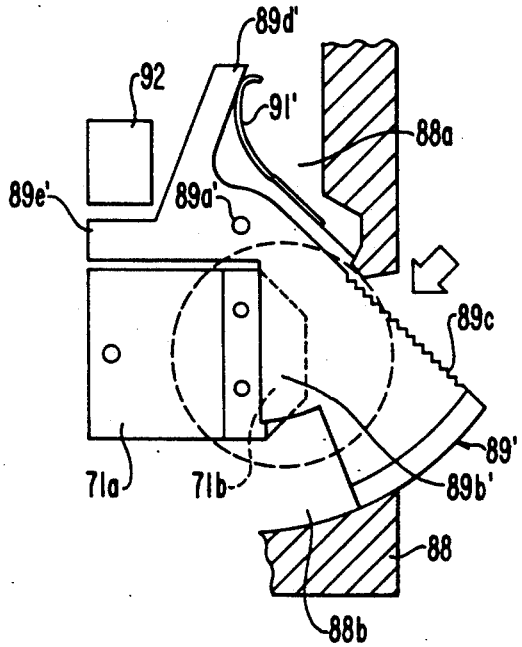
FIG. 17 is a top plan view similar to FIG. 12 of still another specific form of an actuator slide of the snap fastener as shown FIGS. 9 and 10.
Figure 16:
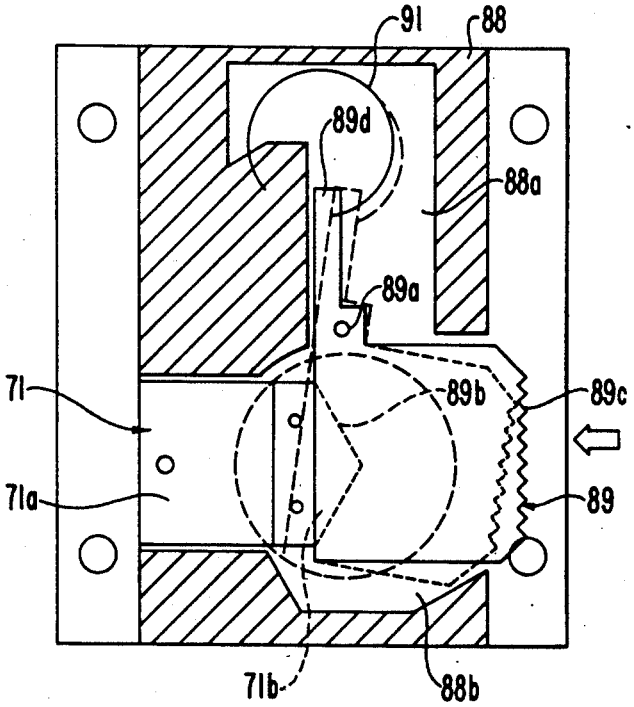
FIG. 16 is a top plan view partly in section of another specific form of an actuator slide of the snap fastener as shown in FIGS. 13 and 14.

Instead of a slide 79, the actuator head can be actuated by a horizontally movable lever, as shown in FIGS. 16 and 17. In FIG. 16, the horizontally movable lever 89 is pivotally mounted on a pivot 89*a* in a cut away part 88*a* of a cover portion 88, and has a head 89*b* with a tapered end (not visible in the plan view) engaged with the tip 71*b* on actuator head 71 and a finger engaging portion 89*c*. An enlarged cut away portion 88*b* allows the head 89*b* to move on a curved path about the pivot 89*a* as it is moved inwardly. A C-shaped return spring 91 mounted in the cover portion 88 and extending into the cut away part 88*a* is engaged with the free end 89*d* of the lever 89 to cause it to pivot counterclockwise in the figure opposite the direction in which the head 89*b* is urged into the cover portion to actuate the actuator head 71.

Alternatively, as shown in FIG. 17, the finger engaging portion 89*c*′ of head 89*b*′ of the lever 89′ can be at an angle to the direction of movement of the tapered end as it acts on the actuator head 71, and the pivot point 89*a*′ can be in a position substantially beside the actuator head 71. The return spring 91′ in this embodiment is a simple leaf spring mounted on the cover portion 88 and engaged with the back of the lever 89*d*′. The free end 89*e*′ of the lever cooperates with a sliding or rotating lock bolt 92 which can be provided in the cover 88 for movement into or out of the path of the free end 89*e*′ as the lever 89′ is pivoted. The lever 89′ can thus be locked against movement, so that the snap fastener can be used on briefcases and the like which preferably can be locked.

It will thus be seen that in these embodiments the force which is exerted on the female member of the snap fastener to move the actuator plate from the convex position to the concave position is exerted transverse to the direction of removal and insertion of the male part out of and into the female part. Thus it is relatively easy to allow the parts of the snap fastener to be moved apart by the force of the spring 52 in the male member and to move the female member of the snap fastener away from the male part. The user does not tend to close the snap fastener further by a force necessary to actuate the dished resilient actuator plate, but rather exerts a simple squeezing action on the slide actuator or lever actuator, thus making the snap fastener more natural to actuate and to move the female member away from the male member.

It will of course be understood that in the embodiments of FIGS. 7–17, the spring 52, 152 or 252 on the male member can be omitted since the force for actuating the actuator plate is being exerted in a direction other than the direction tending to move the female member toward the male member. However, in the most preferred forms of these embodiments, the spring will be included, since it gives a positive separation action to the male member to move it away from the female member promptly upon being released.

The specific means for actuating the dished resilient plate as shown in FIGS. 7–17 will, of course, serve to separate the parts of the fastener without the resilient means of FIGS. 2–6, but the separation of the parts will be enhanced if resilient means is included. The resilient means of the various figures can be any resilient means which will function appropriately.

Figure 18:
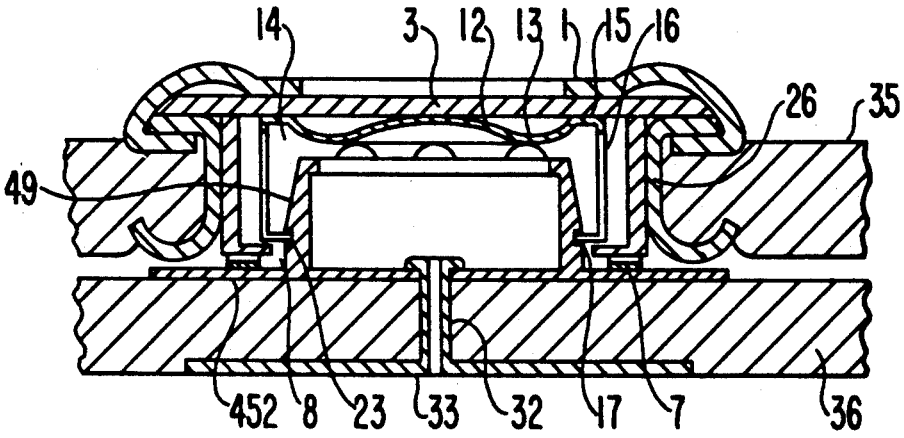
FIG. 18 is a sectional view similar to FIG. 2, but showing a modified form of the snap fastener according to the invention.
Figure 19:
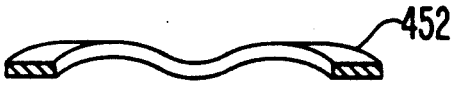
FIGS. 19–22 are sectional elevation views of various embodiments of springs usable in the snap fastener shown in FIG. 18.

Such a resilient means can be as shown in FIGS. 18–22. As shown in the embodiment of FIG. 18, the spring 52 of the embodiment of FIGS. 2 and 3 has been eliminated, and instead a spring means 452 has been provided between the bottom of the inwardly extending flange 7 and the top of the flange 24. Such a resilient means can be any convenient spring means. For example, as shown in FIGS. 18 and 19, it can be a so-called wavy washer spring. It can be secured to either the female member or the male member, and is compressed when the parts are brought together before the hooks 17 are engaged, and is released when the hooks 17 are disengaged.

Figure 20:
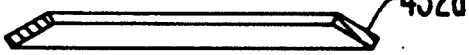
Figure 21:
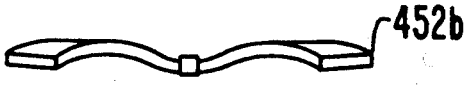
Figure 22:
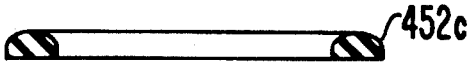

Alternatively, the resilient means can be a so-called Belleville spring, as shown at 452*a* in FIG. 20. The resilient means can be a plurality of wavy washer segments 452*b* as shown in FIG. 21, having the middle wave secured to one or the other of the parts of the fastener. It would also be possible to have one end of the segment secured. Finally, the resilient means can be an annular member of a resilient material such as rubber or resilient plastic, as shown at 452*c* in FIG. 22.

What is claimed is:

1. A snap fastener, comprising:

a female snap member including a snap type resilient clamp having a dished resilient actuator plate and a plurality of legs depending from the periphery thereof having inwardly extending hooks on the free ends thereof and defining a male member receiving recess therewithin, said dished resilient actuator plate being able to be resiliently snapped between a closed position in which said dished resilient actuator plate is convexly dished, and said legs are in an inward position with said hooks in a radially inward engaging position, and an open position in which said dished resilient actuator plate is concavely dished and said legs are in an outwardly inclined position with said hooks in a radially outward disengaging position, and casing means in which said snap type resilient clamp is positioned for movement between said closed position and said open position;

a male member having a hook receiving recess therearound and insertable into said male member receiving recess to position said hook receiving recess in opposed relation to said hooks for causing said male member to be gripped by said hooks when said snap type resilient clamp is in the closed position and for freeing said male member for movement into and out of said male member receiving recess when said snap type resilient clamp is in the open position;

resilient means between said female snap member and said male member for being compressed when said female snap member and said male member are brought together and said hooks are in said engaging position and for urging said female snap member and said male member apart when said dished resilient actuator plate is moved to the concave position for releasing said hooks, said resilient means being positioned on one of the members and having a shape for being protected against accidental snagging or deformation when the members are separated, whereby when said dished resilient actuator plate is depressed to move from the convex to the concave condition, said hooks are moved out of said recess in said male member to free said female snap member from said male member and said resilient means expands to urge said female snap member away from said male member; and actuating means movable in a direction other than the direction of movement of said dished resilient actuator plate between the closed position and the open position and engagable with said dished resilient actuator plate for moving said dished resilient actuator plate from the convex to the concave condition, whereby said hooks are moved out of said recess in said male member to free said female snap member from said male member and to allow said female snap member to move away from said male member.

2. A snap fastener comprising:

a female snap including a snap type resilient clamp having a dished resilient actuator plate and a plurality of legs depending from the periphery thereof having inwardly extending hooks on the free ends thereof and defining a male member receiving recess therewithin, said dished resilient actuator plate being able to be resiliently snapped between a closed position in which said dished resilient actuator plate is convexly dished, and said legs are in an inward position with said hooks in a radially inward engaging position, and an open position in which said dished resilient actuator plate is concavely dished and said legs are in an outwardly inclined position with said hooks in a radially outward disengaging position, and casing means in which said snap type resilient clamp is positioned for movement between said closed position and said open position;

a male member having a hook receiving recess therearound and insertable into said male member receiving recess to position said hook receiving recess in opposed relation to said hooks for causing said male member to be gripped by said hooks when said snap type resilient clamp is in the closed position and for freeing said male member for movement into and out of said male member receiving recess when said snap type resilient clamp is in the open position;

resilient means between said female snap member and said male member for being compressed when said female snap member and said male member are brought together and said hooks are in said engaging position and for urging said female snap member and said male member apart when said dished resilient actuator plate is moved to the concave position for releasing said hooks, said resilient means being positioned on one of the members and having a shape for being protected against accidental snagging or deformation when the members are separated, whereby when said dished resilient actuator plate is depressed to move from the convex to the concave condition, said hooks are moved out of said recess in said male member to free said female snap member from said male member and said resilient means expands to urge said female snap member away from said male member; and one of actuating means movable in a direction transverse to the direction of movement of said dished resilient actuator plate between the closed position and the open position and engagable with said dished resilient actuator plate for moving said dished resilient actuator plate from the convex to the concave condition, and actuating means for exerting a force on said dished resilient actuator plate in a direction for moving it from the closed position to the open position when a force is exerted on said actuator member in the opposite direction to the force on said dished resilient actuator plate, whereby said hooks are moved out of said recess in said male member to free said female snap member from said male member and to allow said female snap member to move away from said male member.

3. A snap fastener comprising:

a female snap member including a snap type resilient clamp having a dished resilient actuator plate and a plurality of legs depending from the periphery thereof having inwardly extending hooks on the free ends thereof and defining a male member receiving recess therewithin, said dished resilient actuator plate being able to be resiliently snapped between a closed position in which said dished resilient actuator plate is convexly dished, and said legs are in an inward position with said hooks in a radially inward engaging position, and an open position in which said dished resilient actuator plate is concavely dished and said legs are in an outwardly inclined position with said hooks in a radially outward disengaging position, and casing means in which said snap type resilient clamp is positioned for movement between said closed position and said open position;

a male member having a hook receiving recess therearound and insertable into said male member receiving recess to position said hook receiving recess in opposed relation to said hooks for causing said male member to be gripped by said hooks when said snap type resilient clamp is in the closed position and for freeing said male member for movement into and out of said male member receiving recess when said snap type resilient clamp is in the open position; and resilient means between said female snap member and said male member for being compressed when said female snap member and said male member are brought together and said hooks are in said engaging position and for urging said female snap member and said male member apart when said dished resilient actuator plate is moved to the concave position for releasing said hooks, said resilient means being positioned on one of the members and having a shape for being protected against accidental snagging or deformation when the members are separated, whereby when said dished resilient actuator plate is depressed to move from the convex to the concave condition, said hooks are moved out of said recess in said male member to free said female snap member from said male member and said resilient means expands to urge said female snap member away from said male member.

4. A snap fastener as claimed in claim 3 further comprising means on said casing means for attaching said casing means to a sheet of material as a female snap member.

5. A snap fastener as claimed in claim 3 further comprising means for attaching said male member to a further sheet of material.

6. A snap fastener as claimed in claim 3 in which said resilient means is a coil spring within the housing of one of said female member and said male member.

7. A snap fastener as claimed in claim 6 in which said coil spring is mounted on said male member and engages with said dished resilient actuator plate when said male member and said casing means are engaged with the snap type resilient clamp in said closed position.

8. A snap fastener as claimed in claim 6 in which said resilient means is a coil spring on one of said dished resilient actuating member and said male member, a sleeve means in which said spring is positioned, and a compression force-transmitting member slidable in said sleeve and urged outwardly of said sleeve toward the other of said dished resilient actuating member and said male member, said compression force-transmitting member being moved into said sleeve to compress said spring when said casing means are engaged with said snap type resilient clamp in said closed position.

9. A snap fastener as claimed in claim 6 in which said resilient means comprises a coil spring on one of said dished resilient actuating member and said male member and a sleeve means in which said spring is positioned, and further comprising a compression force-transmitting member on the other of said dished resilient actuating member and said male member and movable into said sleeve to compress said spring when said casing means are engaged with said snap type resilient clamp in said closed position.

10. A snap fastener as claimed in claim 3 in which said resilient means is an annular spring means lying against a surface on one of said members which is engaged with an opposed surface on the other of said members when said male member is in said male member receiving recess.

11. A snap fastener as claimed in claim 10 in which said resilient member is a wavy washer spring.

12. A snap fastener as claimed in claim 10 in which said resilient member is a Belleville spring.

13. A snap fastener as claimed in claim 10 in which said resilient member is a segment of a wavy washer spring.

14. A snap fastener as claimed in claim 10 in which said resilient means is an annular gasket of a resilient material.

15. A snap fastener as claimed in claim 3 further comprising an actuating means engagable with said dished resilient actuator plate for moving said dished resilient actuator plate from the convex to the concave condition.

16. A snap fastener as claimed in claim 15 in which said actuating means comprises an actuator slide mounted on said casing means for movement laterally across said dished resilient actuator plate in a direction transverse to the direction in which said snap members move away from each other.

17. A snap fastener as claimed in claim 16 in which said actuator slide is pivotally mounted on said casing means.

18. A snap fastener as claimed in claim 16 in which said acuator slide is slidably mounted on said casing means.

19. A snap fastener as claimed in claim 16 further comprising lock means on said casing means for, in a locked condition, blocking movement of said slide means, and in an unlocked condition, freeing said slide means for lateral movement.

20. A snap fastener as claimed in claim 15 in which said actuating means comprises an actuator member for exerting a force on said dished resilient actuator plate in a direction for moving it from the closed position to the open position when a force is exerted on said actuator member in the opposite direction to the force on said dished resilient actuator plate.

21. A snap fastener as claimed in claim 20 in which said casing means has a top portion extending over and covering said dished resilient actuator plate for blocking access to said dished resilient actuator plate other than by means of said actuator member.

22. A snap fastener as claimed in claim 20 in which said actuator member comprises a plurality of levers spaced at intervals around said casing means and each having an inner end over said dished resilient actuator plate and movable toward said dished resilient actuator plate when an outer end is moved away from said male member.

23. A snap fastener as claimed in claim 22, further comprising a ring extending around said levers and connected to the outer ends thereof.

24. A snap fastener as claimed in claim 20 in which said actuator is an actuator lever pivotally mounted on said casing means and has an inner end over said dished resilient actuator plate and movable toward said dished resilient actuator plate when an outer end is moved away from said male member.

25. A snap fastener as claimed in claim 16 in which said casing means has a top portion extending over and covering said dished resilient actuator plate for blocking access to said dished resilient actuator plate other than by means of said actuator slide.

26. A snap fastener comprising:

a snap type resilient clamp having a dished resilient actuator plate and a plurality of legs depending from the periphery thereof having inwardly extending hooks on the free ends thereof and defining a male member receiving recess therewithin, said dished resilient actuator plate being able to be resiliently snapped between a closed position in which said dished resilient actuator plate is convexly dished, and said legs are in an inward position with said hooks in a radially inward engaging position, and an open position in which said dished resilient actuator plate is concavely dished and said legs are in an outwardly inclined position with said hooks in a radially outward disengaging position, and casing means in which said snap type resilient clamp is positioned for movement between said closed position and said open position;

a male member having a hook receiving recess therearound and insertable into said male member receiving recess to position said hook receiving recess in opposed relation to said hooks for causing said male member to be gripped by said hooks when said snap type resilient clamp is in the closed position and for freeing said male member for movement into and out of said male member receiving recess when said snap type resilient clamp is in the open position; and actuating means movable in a direction transverse to the direction of movement of said dished resilient actuator plate between the closed position and the open position and engagable with said dished resilient actuator plate for moving said dished resilient actuator plate from the convex to the concave condition, whereby said hooks are moved out of said recess in said male member to free said female snap member from said male member and to allow said female snap member to move away from said male member.

27. A snap fastener as claimed in claim 26 in which said actuating means comprises an actuator slide mounted on said casing means for movement laterally across said dished resilient actuator plate in a direction transverse to the direction in which said snap members move away from each other for changing said plate from the convex shape to the concave shape.

28. A snap fastener as claimed in claim 27 in which said actuator slide is pivotally mounted on said casing means.

29. A snap fastener as claimed in claim 27 in which said acuator slide is slidably mounted on said casing means.

30. A snap fastener as claimed in claim 27 further comprising lock means on said casing means for, in a locked condition, blocking movement of said slide means, and in an unlocked condition, freeing said slide means for lateral movement.

31. A snap fastener as claimed in claim 30 in which said actuator is a plurality of levers each pivotally mounted on said casing means and having an inner end over said dished resilient actuator plate and movable toward said dished resilient actuator plate when an outer end is moved.

32. A snap fastener comprising:

a snap type resilient clamp having a dished resilient actuator plate and a plurality of legs depending from the periphery thereof having inwardly extending hooks on the free ends thereof and defining a male member receiving recess therewithin, said dished resilient actuator plate being able to be resiliently snapped between a closed position in which said dished resilient actuator plate is convexly dished, and said legs are in an inward position with said hooks in a radially inward engaging position, and an open position in which said dished resilient actuator plate is concavely dished and said legs are in an outwardly inclined position with said hooks in a radially outward disengaging position, and casing means in which said snap type resilient clamp is positioned for movement between said closed position and said open position;

a male member having a hook receiving recess therearound and insertable into said male member receiving recess to position said hook receiving recess in opposed relation to said hooks for causing said male member to be gripped by said hooks when said snap type resilient clamp is in the closed position and for freeing said male member for movement into and out of said male member receiving recess when said snap type resilient clamp is in the open position; and actuating means for exerting a force on said dished resilient actuator plate in a direction for moving it from the closed position to the open position when a force is exerted on said actuator member in the opposite direction to the force on said dished resilient actuator plate.

33. A snap fastener as claimed in claim 32 in which said actuator is an actuator lever pivotally mounted on said casing means and has an inner end over said dished resilient actuator plate and movable toward said dished resilient actuator plate when an outer end is moved.

34. A snap fastener as claimed in claim 31 in which said casing means has a top portion extending over and covering said dished resilient actuator plate for blocking access to said dished resilient actuator plate other than by means of said actuator means.

35. A snap fastener as claimed in claim 31 in which said actuator member comprises a plurality of levers spaced at intervals around said casing means and each having an inner end over said dished resilient actuator plate and movable toward said dished resilient actuator plate when an outer end is moved away from said male member, and a ring extending around said levers and connected to the outer ends thereof.

* * * * *